US006561063B1

(12) United States Patent
Mulford et al.

(10) Patent No.: US 6,561,063 B1
(45) Date of Patent: May 13, 2003

(54) HAND-HELD ROTARY CUT-OFF TOOL

(75) Inventors: Ronald J. Mulford, Aurora, IN (US); Gary S. Bass, Independence, KY (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 166 days.

(21) Appl. No.: 09/641,311

(22) Filed: Aug. 18, 2000

(51) Int. Cl.[7] ..... B26B 29/00; B23D 45/16

(52) U.S. Cl. ..... 82/128; 82/152; 30/390; 451/354

(58) Field of Search ..... 82/128, 152, 158, 82/160, 173; 30/390, 391, 284; 451/354, 358, 456

(56) References Cited

U.S. PATENT DOCUMENTS 4,281,457 A * 8/1981 Walton, II ..... 30/124
4,463,636 A * 8/1984 Heller et al. ..... 83/13
4,993,243 A * 2/1991 Guinn ..... 30/390
5,012,582 A * 5/1991 Bristol et al. ..... 30/390
5,609,516 A * 3/1997 Courson et al. ..... 451/456
5,784,789 A * 7/1998 Vargas ..... 30/388
5,791,979 A * 8/1998 Duncan et al. ..... 451/456
6,027,399 A * 2/2000 Stewart ..... 451/353
6,048,260 A * 4/2000 Kopras ..... 451/358
6,120,362 A * 9/2000 Etter et al. ..... 451/354
6,149,511 A * 11/2000 Huber ..... 451/357
6,389,701 B1 * 5/2002 Friedland ..... 378/145

* cited by examiner

*Primary Examiner*—Henry W. H. Tsai
(74) *Attorney, Agent, or Firm*—Jones Day

(57) ABSTRACT

A rotary cut-off tool has a hand-held housing. The housing has an open end centered on an axis and a housing abutment surface facing axially outward of the open end. A motor within the housing has an output shaft. A guard has a guard flange with a mounting hole. An arbor is configured to extend axially from the shaft through the mounting hole. A cut-off disk is receivable on the arbor. A spring has an installed position compressively engaged by and between the housing abutment surface and the guard flange, such that the spring releasably restrains the guard from swiveling about the axis.

7 Claims, 4 Drawing Sheets

HAND-HELD ROTARY CUT-OFF TOOL

FIELD OF THE INVENTION

The present invention relates to a protective guard for a hand-held rotary cut-off tool.

BACKGROUND OF THE INVENTION

A hand-held rotary cut-off tool has an abrasive rotary cut-off disk driven by an electric or pneumatic motor, and is used to cut a workpiece. The cut-off tool typically has a protective guard that partially surrounds the cut-off disk.

FIG. 1 shows a prior art pneumatic hand-held rotary cut-off tool 10. The tool 10 has a housing 12 configured to be grasped by hand. The tool 10 also has an abrasive cut-off disk 14 attached to the end of an arbor 16, concentrically aligned along a rotational axis 18. A pneumatic motor 20 within a cavity 22 of the housing 12 rotates the arbor 16 and the cut-off disk 14 about the axis 18. The tool 10 also has a half-bell shaped protective guard 24. The guard 24 can swivel about the axis 18 as needed for adjustment but does not rotate with the disk 14.

FIG. 2 shows an exploded view of major components of the cut-off tool 10 of FIG. 1. The tool 10 has a nut 30 which serves to indirectly attach the guard 24 to the housing 12. The nut 30 has a non-threaded nut bore 32 extending along the axis 18 entirely through the nut 30. The nut 30 also has an external screw-thread 34 at one end, a torque structure 36, having two flats 38, at the other end, and a smooth nut shank portion 40 in-between. The nut shank portion 40 has a circumferentially-extending groove 42. A nut abutment surface 44 is located between the external screw-thread 34 and the nut shank portion 40.

The cut-off disk 14 is attached by a screw 46 to the arbor 16. The arbor 16 passes through the nut bore 32 and is connected to and rotated by an output shaft 48 of the motor 20. The nut 30 is screwed into the housing 12.

The guard 24 has a flat guard flange 50 with a mounting hole 52 that receives the nut shank portion 40. The guard flange 50 is held in place, on its axially-inner side, by a first flat washer 54, a wave washer 56 and the nut abutment surface 44. The guard flange 50 is held in place, on its axially-outer side, by a second flat washer 58 and a retaining ring 60 that snaps into the groove 42. The wave washer 56 is compressively engaged by and between the nut abutment surface 44 and the flat washer 54. Pressure from the wave washer 56 is transmitted through the flat washer 54 to the guard flange 50 and causes the guard 24 to be releasably restrained from swiveling about the nut shank portion 40.

FIG. 3 shows an exploded view of major components of a second prior art cut-off tool 62. The components and overall design of the second cut-off tool 62 are similar to those of the first cut-off tool 10. The second prior art cut-off tool 62 has a nut 64 which serves the same function as the nut 30 of the first cut-off tool 10. The nut 64 has a non-threaded nut bore 66. The nut 64 also has an external screw-thread 70 at one end, a smooth nut shank portion 72 at the other end, and a torque structure 74, having six flats 76, in-between. The nut shank portion 72 has a retaining ring groove 78. A nut abutment surface 80 is located between the torque structure 74 and the nut shank portion 72. The second cut-off tool 62 also has a guard 82 similar to the guard 24 of the first cut-off tool 10. A wave washer 84 is compressively engaged by and between the nut abutment surface 80 and a guard flange 86.

Some differences between the first and second prior art cut-off tools 10 and 62 are as follows. The second prior art tool 62 lacks the flat washers 54 and 58 of the first prior art tool 10. The shank portion 72, the torque structure 74 and the abutment surface 80 of the nut 64 of the second prior art tool 62 are disposed in a different sequence than the corresponding features (the shank portion 40, the torque structure 36, and the abutment surface 44) of the nut 30 of the first prior art tool 10.

SUMMARY OF THE INVENTION

In accordance with the invention, a rotary cut-off tool has a hand-held housing. The housing has an open end centered on an axis, and has a housing abutment surface facing axially outward of the open end. A motor within the housing has an output shaft extending along the axis. A guard has a guard flange with a mounting hole. An arbor is configured to extend axially from the shaft through the mounting hole. The tool further has a spring and a cut-off disk receivable on the arbor. The spring has an installed position compressively engaged by and between the housing abutment surface and the guard flange, such that the spring releasably restrains the guard from swiveling about the axis.

In a preferred embodiment of the invention, the housing further has an internal screw-thread centered on the axis, and the tool further has a tubular fitting. The fitting has a bore that receives the arbor. An external screw-thread on the fitting is engageable with the internal screw-thread in the housing. The fitting further has an axially facing abutment surface, and a shank portion between the fitting abutment surface and the external screw-thread. When installed, the spring is received over the shank portion of the fitting.

DESCRIPTION OF A PREFERRED EMBODIMENT

Figure 1:
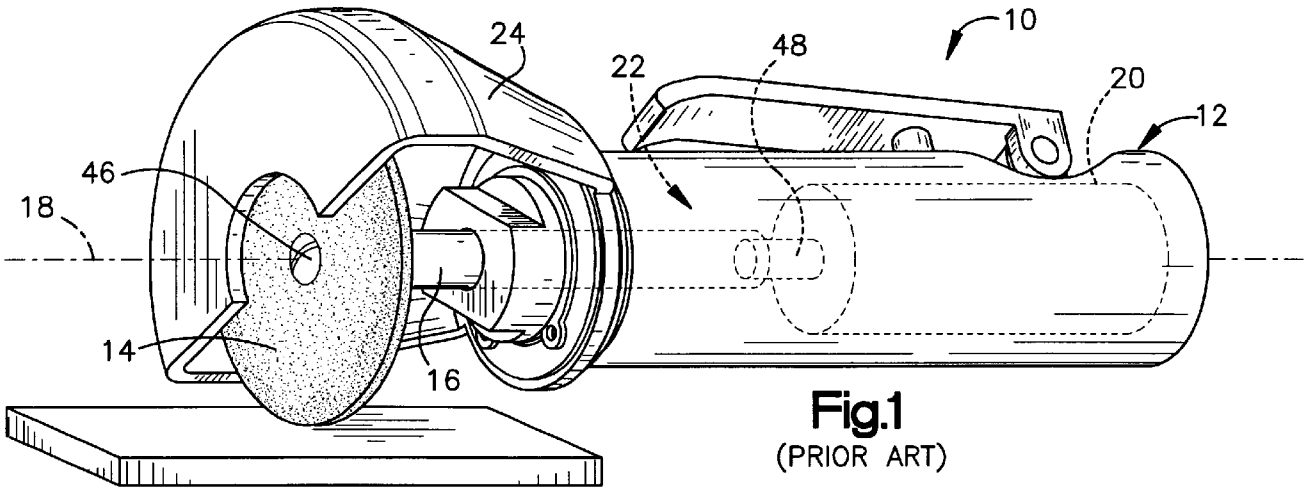
Fig.1 (PRIOR ART)
FIG. 1 is a perspective view of a first prior art rotary cut-off tool.
Figure 2:
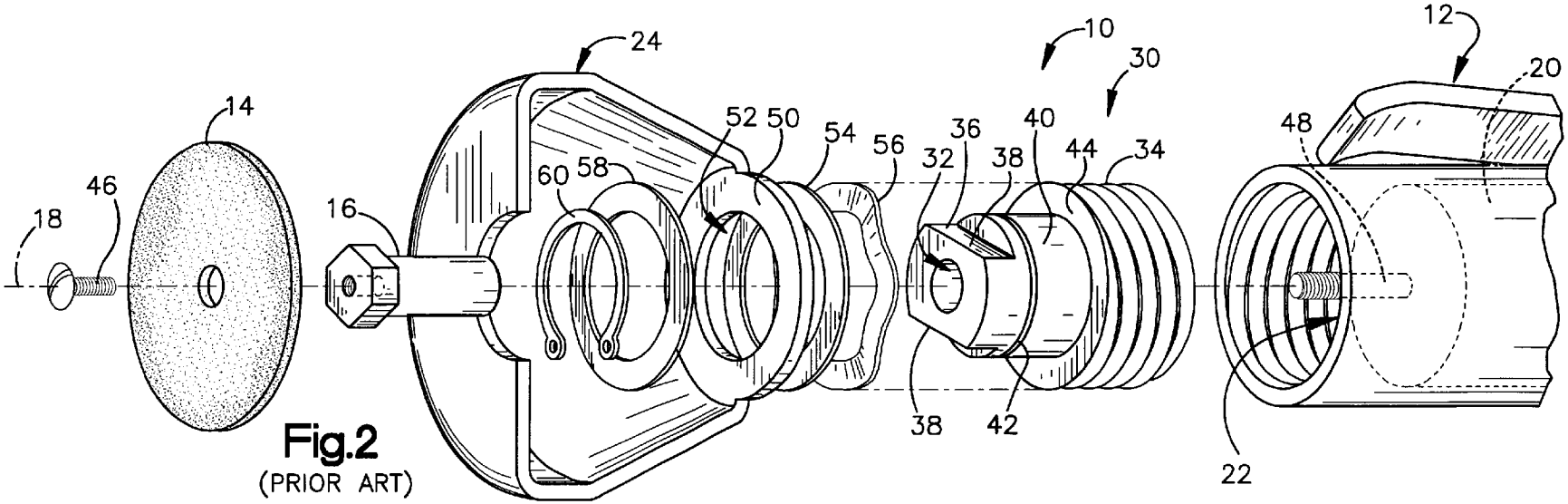
Fig.2 (PRIOR ART)
FIG. 2 is an exploded perspective view of the cut-off tool of FIG. 1.
Figure 3:
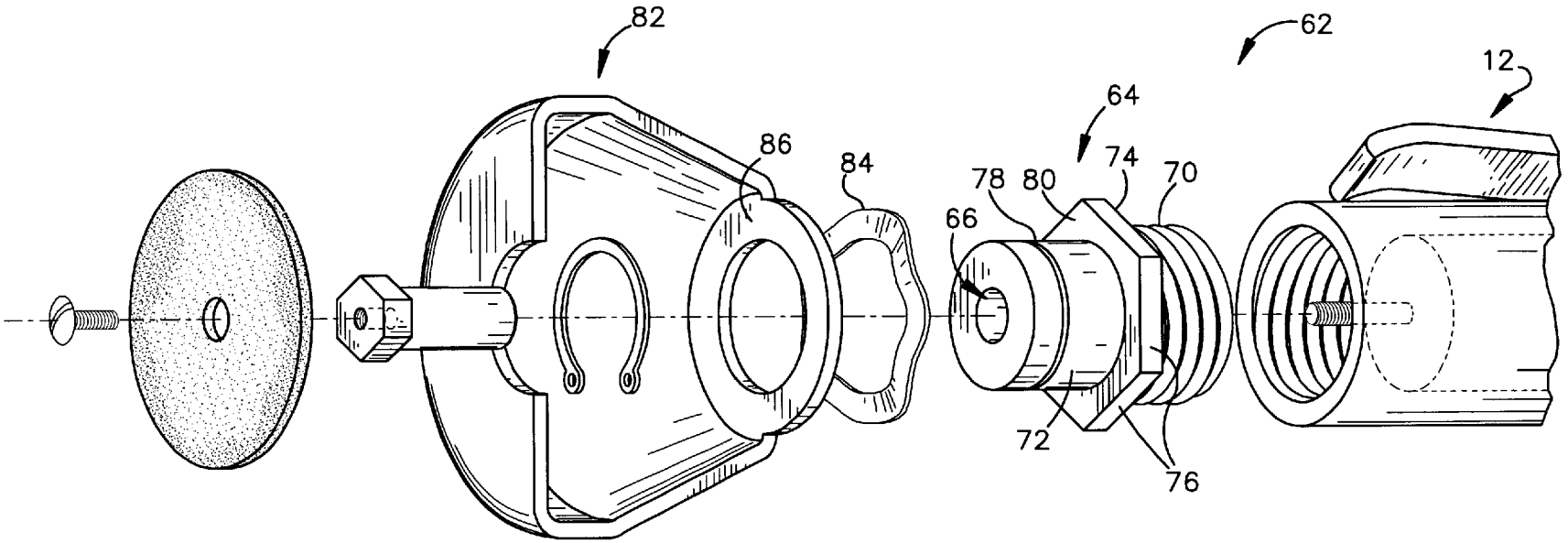
Fig.3 (PRIOR ART)
FIG. 3 is an exploded perspective view of a second prior art rotary cut-off tool.
Figure 4:
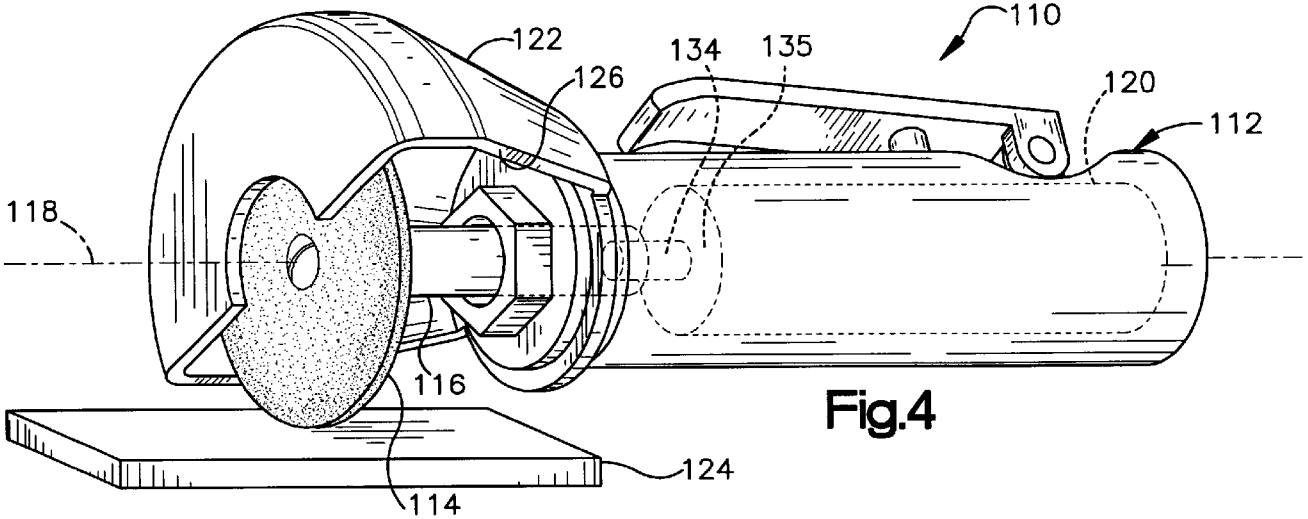
FIG. 4 is a perspective view of a rotary cut-off tool comprising a preferred embodiment of the present invention.

FIG. 4 shows a perspective view of a hand-held pneumatic rotary cut-off tool 110 comprising a preferred embodiment of the present invention. The cut-off tool 101 has a housing 112. The cut-off tool 110 also has an abrasive cut-off disk 114 at the end of an arbor 116, concentrically aligned on a rotational axis 118. A pneumatic motor 120 within the housing 112 rotates the arbor 116 and the cut-off disk 114 about the axis 118. A half-bell shaped protective guard 122 surrounds approximately half the cut-off disk 114. The guard 122 can swivel about the axis 118 as needed for adjustment but does not rotate with the disk 114.

Figure 5:
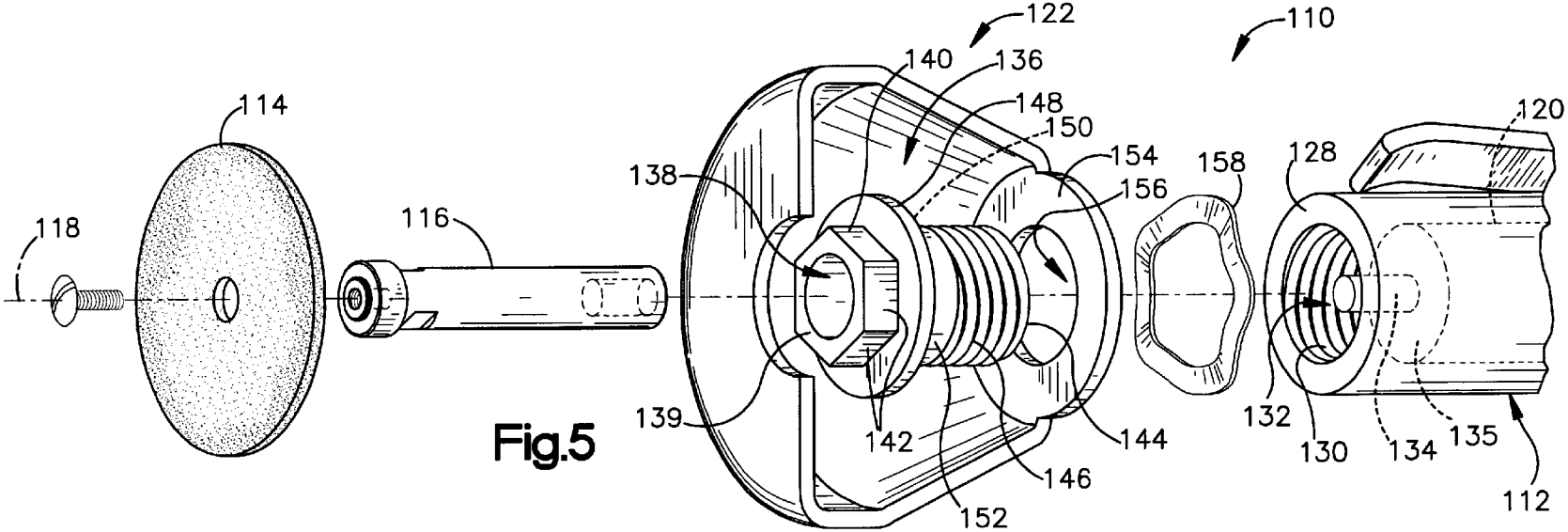
FIG. 5 is an exploded perspective view of the cut-off tool of FIG. 4.

FIG. 5 shows an exploded view of major components of the cut-off tool 110 of FIG. 4. The housing 112 has an annular open end surface 128, an internal screw-thread 130 extending axially inward from the end surface 128, and a cavity 132. Within the cavity 132, the motor 120 has an output shaft 134 protruding through a front end plate 135. In the preferred embodiment, the arbor 116 is press-fitted over the output shaft 134, as shown in FIG. 7, but screw threads or any other suitable connecting structure could be used as an alternative.

The tool 110 further includes a tubular fitting 136, which may be referred to as a nut. A non-threaded bore 138 in the nut 136 extends axially entirely through the nut 136. The bore 138 is configured to receive the arbor 116. At the axially-outer end 139 of the nut 136 is a tightening structure, preferably an external hex head 140 with flats 142, configured to enable tightening the nut 136 with a tightening tool such as a wrench. An external screw thread 146 extends from the axially inner end 144 of the nut 136. The external screw-thread 146 is configured to engage the internal screw-thread 130 of the housing 112. A nut flange 148, adjacent the hex head 140, has an axially-inner abutment surface 150 (FIG. 6) opposite the hex head 140 and facing the end surface 128. The nut 136 also has a smooth cylindrical nut shank portion 152 between the nut abutment surface 150 and the external screw-thread 146.

At the base of the guard is a flat guard flange 154 with a circular mounting hole 156 that is configured to receive the nut shank portion 152. The tool 110 further has a spring 158, in this case a wave washer, configured to receive the nut shank portion 152 and to forcefully engage the guard flange 154.

Figure 6:
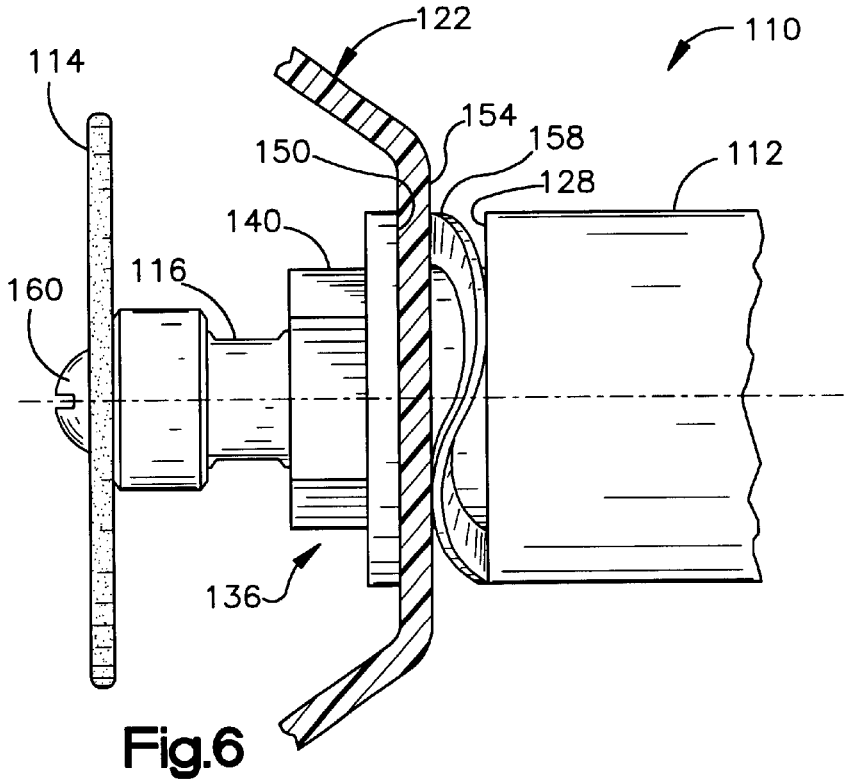
FIG. 6 is a partial side view of the cut-off tool of FIG. 5 when assembled.
Figure 7:
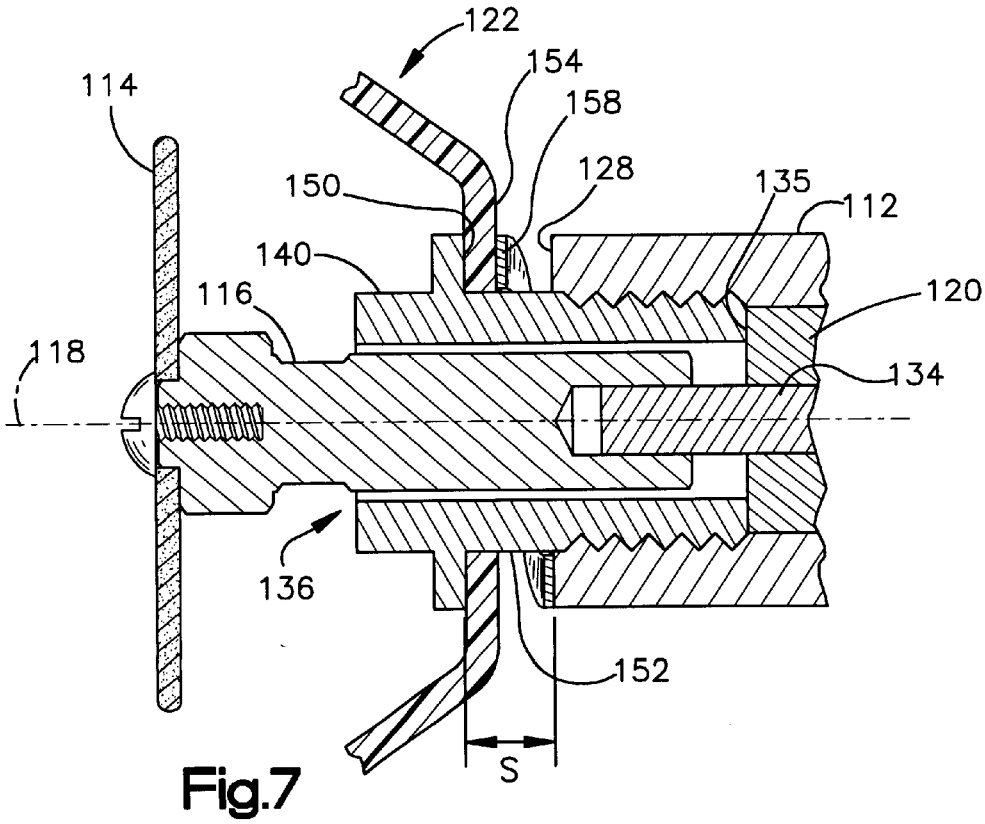
FIG. 7 is a partial sectional side view of the cut-off tool of FIG. 5 when assembled.

When assembling the cut-off tool 110, first the guard flange 154 is slipped over the nut shank portion 152, as seen in FIGS. 5–7. Then, the wave washer 158 is slipped over the nut shank portion 152, to the right of the guard flange 154 as shown in FIGS. 5–7. The nut 136 is screwed into the housing 112. The hex head 140 is turned with a wrench until the nut 136 is forcefully pressed against the front end plate 135 of the motor 120. In this configuration, the external thread 146 engages the internal thread 130, and the guard flange 154 and the wave washer 158 are captured axially between the nut abutment surface 150 and the open end surface 128.

The wave washer 158 applies a spring force against the guard flange 154. The spring force releasably restrains rotation of the guard 122 about the nut shank 152. Therefore, the guard 122 will not swivel about the axis 118 unless the operator manually rotates the guard 122 with sufficient force to overcome the spring force.

In accordance with a particular feature of the invention, the nut 136 defines a specified spacing S, shown in FIG. 7, that is optimal for compressing the wave washer 158. Specifically, when the nut 136 is screwed into the housing 112 and abuts the motor, a specified axial spacing S exists between the nut abutment surface 150 and the open end surface 128. In designing the cut-off tool 110, the spacing S is chosen such that pressure from the wave washer 158 against the guard flange 154 renders the guard flange 154 releasably restrained from swiveling about the nut shank portion 152, as described above.

The invention has been described with reference to a preferred embodiment. Those skilled in the art will perceive improvements, changes and modifications as taught by the foregoing description. Such improvements, changes and modifications are intended to be within the scope of the claims.

What is claimed is:

1. An apparatus comprising:

a hand-held housing having an open end centered on an axis and a housing abutment surface facing axially outward of said open end;

a motor, within said housing, having an output shaft extending along said axis;

a guard having a guard flange with a mounting hole;

an arbor configured to extend axially from said shaft through said mounting hole;

a cut-off disk receivable on said arbor; and a spring configured to be received in an installed position in which said spring is compressively engaged by and between said housing abutment surface and said guard flange, such that said spring releasably restrains said guard from swiveling about said axis;

said housing further having an internal screw-thread centered on said axis; and said apparatus further comprising a tubular fitting having a bore that receives said arbor, an external screw-thread that is engageable with said internal screw-thread, an axially facing fitting abutment surface, and a fitting shank portion between said fitting abutment surface and said external screw-thread;

with said spring being received over said fitting shank portion when said spring is in said installed position.

2. An apparatus comprising:

a hand-held housing having an open end centered on an axis, an internal screw-thread centered on said axis, and a housing abutment surface facing axially outward of said open end;

a motor, within said housing, having an output shaft;

an arbor attached to said output shaft;

a cut-off disk fastened to said arbor;

a tubular fitting having:

a bore that receives said arbor;

an external screw-thread that is engaged with said internal screw-thread;

a fitting abutment surface facing axially toward said housing abutment surface; and a fitting shank portion located axially between said fitting abutment surface and said external screw-thread;

a guard partially surrounding said cut-off disk, said guard having an annular guard flange received over said fitting shank portion axially between said housing abutment surface and said fitting abutment surface; and a spring received over said fitting shank portion, said spring being compressed axially between said housing abutment surface and said guard flange, whereby said guard is releasably restrained from swiveling about said fitting shank portion by a restraining force applied by said spring.

3. An apparatus as defined in claim 2 wherein said fitting abuts said motor.

4. An apparatus as defined in claim 2 wherein said housing abutment surface is an axially-outer edge of said annular open end.

5. An apparatus as defined in claim 2 wherein said fitting has a structure, at an axially-outer end of said fitting, configured to enable turning said fitting by a tightening tool.

6. An apparatus as defined in claim 5 wherein said structure comprises flats configured to enable turning said fitting by a wrench.

7. An apparatus comprising:

a hand-held housing having an open end, a housing abutment surface facing outward of said open end, and an internal screw thread;

a motor, within said housing, having an output shaft;

a guard having a guard flange with a mounting hole;

an arbor configured to extend from said shaft through said mounting hole;

a cut-off disk receivable on said arbor;

spring configured to be received in an installed position in which said spring is compressively engaged by and between said housing abutment surface and said guard flange, such that said spring releasably restrains said guard from swiveling about said arbor; and a tubular fitting having a bore that receives said arbor, an external screw-thread that is engageable with said internal screw-thread, a fitting abutment surface, and a fitting shank portion between said fitting abutment surface and said external screw thread;

with said spring being received over said fitting shank portion when said spring is in said installed position.

* * * * *